US010914548B2

(12) United States Patent
Miller et al.

(10) Patent No.: US 10,914,548 B2
(45) Date of Patent: Feb. 9, 2021

(54) POWER SYSTEM FOR A FIREARM

(71) Applicant: T-Worx Holdings, LLC, Ashburn, VA (US)

(72) Inventors: Tyler Miller, Dickerson, MD (US); Ben Feldman, Reston, VA (US); Joseph Ellena, Herndon, VA (US); Martin Fisher, Annapolis, MD (US); Wayne Taylor, Ashburn, VA (US); Eric Cabahug, Fairfax, VA (US); Gary Callsen, Ashburn, VA (US)

(73) Assignee: T-Worx Holdings, LLC, Sterling, VA (US)

( * ) Notice: Subject to any disclaimer, the term of this patent is extended or adjusted under 35 U.S.C. 154(b) by 47 days.

(21) Appl. No.: 15/980,524

(22) Filed: May 15, 2018

(65) Prior Publication Data

US 2019/0137213 A1 May 9, 2019

Related U.S. Application Data

(60) Provisional application No. 62/506,537, filed on May 15, 2017.

(51) Int. Cl.

| | |
|---|---|
| ***F41C 23/22*** | (2006.01) |
| ***F41C 23/04*** | (2006.01) |
| ***F41C 23/14*** | (2006.01) |
| ***F41A 3/84*** | (2006.01) |

(52) U.S. Cl.

CPC ..... *F41C 23/22* (2013.01); *F41A 3/84* (2013.01); *F41C 23/04* (2013.01); *F41C 23/14* (2013.01)

(58) Field of Classification Search

CPC ..... F41C 23/22; F41C 23/04; F41C 23/14; F41A 3/84

USPC ..... 89/199

See application file for complete search history.

(56) References Cited

U.S. PATENT DOCUMENTS

| | | | | |
|---|---|---|---|---|
| 1,950,835 | A * | 3/1934 | Jozef Zajac | F41G 1/35 362/114 |
| 4,533,980 | A | 8/1985 | Hayes | |
| 4,595,809 | A | 6/1986 | Pool | |
| 4,777,861 | A | 10/1988 | Lecuyer et al. | |
| 4,883,932 | A | 11/1989 | Van Hout et al. | |
| 4,931,605 | A | 6/1990 | Zoller | |

(Continued)

FOREIGN PATENT DOCUMENTS

WO 2016118218 A1 7/2016

OTHER PUBLICATIONS

Patent Cooperation Treaty International Searching Authority, Written Opinion of the International Searching Authority, dated Aug. 29, 2018, 8 pages.

(Continued)

*Primary Examiner* — Michelle Clement
(74) *Attorney, Agent, or Firm* — Merchant & Gould P.C.

(57) ABSTRACT

A power system for a firearm includes a buffer tube adapter that attaches to a buffer tube of the firearm. A buttstock slidably engages with the buffer tube adapter along an axis, and the buttstock is adapted to adjust a length of the firearm. A power source is held by the buffer tube adapter and is at least partially covered by the buttstock. The power source is configured to power electronic accessories mounted to the firearm. The power system is mountable to the firearm without altering the buffer tube of the firearm.

17 Claims, 12 Drawing Sheets

(56) References Cited

U.S. PATENT DOCUMENTS 5,033,219 A 7/1991 Johnson et al.
5,142,806 A 9/1992 Swan
5,237,773 A * 8/1993 Claridge ..... F41G 1/35 362/113
5,360,949 A 11/1994 Duxbury
5,669,174 A 9/1997 Teetzel
5,822,905 A 10/1998 Teetzel
5,826,363 A 10/1998 Olson
6,163,131 A 12/2000 Gartstein et al.
6,219,952 B1 * 4/2001 Mossberg ..... F41A 17/063 42/70.01
6,237,271 B1 5/2001 Kaminski
6,513,251 B2 * 2/2003 Huang ..... F41G 1/345 33/286
6,618,976 B1 9/2003 Swan
6,622,416 B2 9/2003 Kim
6,925,744 B2 8/2005 Kincel
6,931,775 B2 8/2005 Burnett
6,965,085 B1 11/2005 Orrico et al.
7,144,830 B2 12/2006 Hill et al.
7,243,454 B1 7/2007 Cahill
RE40,216 E 4/2008 Swan
7,421,818 B2 9/2008 Houde-Walter
7,438,430 B2 * 10/2008 Kim ..... F41G 1/34 200/18
7,464,495 B2 12/2008 Cahill
7,525,203 B1 4/2009 Racho
7,548,697 B2 6/2009 Hudson et al.
7,559,169 B2 7/2009 Hung et al.
7,562,483 B2 7/2009 Hines
7,584,569 B2 8/2009 Kallio et al.
7,627,975 B1 12/2009 Hines
7,640,690 B2 1/2010 Hines
7,676,975 B2 3/2010 Phillips et al.
7,712,241 B2 5/2010 Teetzel et al.
7,818,910 B2 10/2010 Young
7,827,726 B2 11/2010 Stokes
7,841,120 B2 11/2010 Teetzel et al.
7,866,083 B2 1/2011 Teetzel
7,908,784 B2 * 3/2011 Kim ..... F41G 11/003 42/146
7,954,971 B1 6/2011 Kincaid et al.
7,966,760 B2 6/2011 Fitzpatrick et al.
7,975,419 B2 7/2011 Darian
8,001,715 B2 8/2011 Stokes
8,028,460 B2 * 10/2011 Williams ..... F41G 11/003 42/84
8,042,967 B2 10/2011 Hikmet et al.
8,091,265 B1 1/2012 Teetzel et al.
8,141,288 B2 3/2012 Dodd et al.
8,146,282 B2 4/2012 Cabahug et al.
8,151,505 B2 4/2012 Thompson
8,225,542 B2 * 7/2012 Houde-Walter ..... F41A 35/00 42/72
8,322,064 B2 12/2012 Cabahug et al.
8,347,541 B1 * 1/2013 Thompson ..... F41G 11/003 42/84
8,371,729 B2 * 2/2013 Sharrah ..... F21S 9/02 362/439
8,397,418 B2 3/2013 Cabahug et al.
8,402,683 B2 3/2013 Cabahug et al.
8,443,539 B2 5/2013 Cabahug et al.
8,448,368 B2 5/2013 Cabahug et al.
8,453,369 B1 6/2013 Kincaid et al.
8,458,944 B2 * 6/2013 Houde-Walter ..... F41A 35/00 42/72
8,464,459 B1 * 6/2013 Summers ..... F41A 17/063 42/70.08
8,516,731 B2 8/2013 Cabahug et al.
8,635,798 B2 * 1/2014 Mulfinger ..... F41C 27/00 42/84
9,285,185 B2 3/2016 Cabahug et al.
2003/0029072 A1 * 2/2003 Danielson ..... F41G 1/35 42/114
2005/0241206 A1 11/2005 Teetzel et al.
2006/0288626 A1 * 12/2006 Kim ..... F41C 27/00 42/73
2008/0010890 A1 1/2008 Vice et al.
2008/0025028 A1 1/2008 Gloisten et al.
2008/0039962 A1 2/2008 McRae
2008/0040965 A1 2/2008 Solinsky et al.
2008/0063400 A1 3/2008 Hudson et al.
2008/0134562 A1 6/2008 Teetzel
2008/0170838 A1 7/2008 Teetzel et al.
2008/0190002 A1 8/2008 Hines
2009/0044439 A1 2/2009 Phillips et al.
2009/0108589 A1 4/2009 Racho
2009/0218884 A1 * 9/2009 Soar ..... F41H 1/02 307/11
2009/0255160 A1 10/2009 Summers
2010/0031552 A1 2/2010 Houde-Walter
2010/0083553 A1 4/2010 Montgomery
2010/0095574 A1 * 4/2010 Abst ..... F41A 19/06 42/69.01
2010/0154276 A1 * 6/2010 Kim ..... F41C 27/00 42/90
2010/0180485 A1 7/2010 Cabahug et al.
2010/0192443 A1 8/2010 Cabahug et al.
2010/0192444 A1 8/2010 Cabahug et al.
2010/0192446 A1 8/2010 Darian
2010/0192447 A1 * 8/2010 Cabahug ..... F41C 23/22 42/84
2010/0192448 A1 8/2010 Darian
2010/0218410 A1 9/2010 Cabahug et al.
2010/0242332 A1 9/2010 Teetzel et al.
2010/0275489 A1 11/2010 Cabahug et al.
2010/0281725 A1 * 11/2010 Arbouw ..... F41A 9/62 42/1.02
2011/0000120 A1 1/2011 Thompson
2011/0010979 A1 1/2011 Houde-Walter
2011/0031928 A1 * 2/2011 Soar ..... F41G 1/34 320/108
2011/0061284 A1 * 3/2011 Cabahug ..... F41C 23/22 42/73
2011/0115303 A1 * 5/2011 Baarman ..... H02J 17/00 307/104
2011/0126622 A1 6/2011 Turner
2011/0162251 A1 7/2011 Houde-Walter
2011/0173865 A1 7/2011 Compton et al.
2011/0214328 A1 * 9/2011 Williams ..... F41G 11/003 42/90
2011/0283585 A1 * 11/2011 Cabahug ..... F41C 23/22 42/73
2011/0283586 A1 * 11/2011 Scallie ..... F41A 17/063 42/84
2011/0306251 A1 * 12/2011 Mulfinger ..... H01R 12/91 439/733.1
2012/0131837 A1 * 5/2012 Cabahug ..... F41C 23/22 42/84
2012/0144716 A1 * 6/2012 Cabahug ..... F41C 23/22 42/84
2012/0174456 A1 7/2012 Depierro et al.
2012/0180364 A1 * 7/2012 Berntsen ..... F41G 11/003 42/90
2012/0192476 A1 * 8/2012 Compton ..... F41G 11/003 42/84
2012/0285064 A1 * 11/2012 Houde-Walter ..... F41A 35/00 42/72
2013/0047482 A1 * 2/2013 Mulfinger ..... F41C 27/00 42/84
2013/0061504 A1 3/2013 Malherbe et al.
2013/0185978 A1 * 7/2013 Dodd ..... F41G 11/003 42/84
2014/0007485 A1 * 1/2014 Castejon, Sr. ..... F41G 1/35 42/117
2014/0059911 A1 * 3/2014 Oh ..... F41C 23/22 42/16
2014/0130392 A1 * 5/2014 Oh ..... F41G 11/003 42/84
2015/0020427 A1 1/2015 Compton et al.

(56) References Cited

U.S. PATENT DOCUMENTS

| | | | | |
|---|---|---|---|---|
| 2015/0300786 | A1 | 10/2015 | Downing et al. | |
| 2018/0328698 | A1* | 11/2018 | Miller | F41G 3/02 |
| 2019/0137213 | A1* | 5/2019 | Miller | F41C 23/04 |

OTHER PUBLICATIONS

Third Party Submission Under 37 CFR 1.99 submitted May 12, 2011 in U.S. Appl. No. 12/950,979, filed Nov. 19, 2010, by Micahel Blain Brooks, P.C., 3 pages.

* cited by examiner

POWER SYSTEM FOR A FIREARM

CROSS-REFERENCE TO RELATED APPLICATIONS

This application claims priority to and the benefit of U.S. Provisional Patent Application No. 62/506,537, filed May 15, 2017, entitled "POWER SYSTEM FOR A FIREARM", the disclosure of which is hereby incorporated by reference herein in its entirety.

GOVERNMENT RIGHTS

This invention was made with government support under contract W15QKN-13-C-0032 awarded by the United States Army. The government has certain rights in the invention.

INTRODUCTION

Accessories such as lights, cameras, laser range finders, infrared sensors, displays, and radios may be added to firearms to improve the situational awareness of the firearm user. However, firearm mounted accessories can increase the weight and bulk of a firearm because of the additional weight that results from each accessory having a separate battery system. Also, different firearm mounted accessories may require different types of batteries which can make it burdensome to carry multiple types of spare batteries for the firearm mounted accessories.

SUMMARY

In general terms, this disclosure is directed to firearms. In one configuration and by non-limiting example, a power system for a firearm enables attached accessory devices to draw power from a central power source and to communicate with the user and/or other devices.

In one aspect, the disclosed technology relates to a power system for a firearm that includes a buffer tube adapter configured to attach to a buffer tube of the firearm. A buttstock is slidably engaged with the buffer tube adapter along an axis, and the buttstock is configured to adjust a length of the firearm. A power source is held by the buffer tube adapter and at least partially covered by the buttstock. The power source is configured to power electronic accessories mounted to the firearm. The power system is mountable to the firearm without altering the buffer tube of the firearm.

In some examples, the power system includes a mounting bracket that secures the buffer tube adapter to the buffer tube of the firearm. In some examples, the power source is held inside a compartment of the buffer tube adapter, and the compartment is axially aligned with a channel in the buttstock. In some examples, the buffer tube adapter includes indexing notches that lock the buttstock in multiple intermediate positions along the axis. In some examples, the power source is configured to connect to a power socket mounted to a grip of the firearm. In some examples, the power source comprises AA batteries. In other examples, the power source comprises rechargeable batteries. In other examples, the power source comprises a fuel cell.

In some examples, the power source is housed inside a housing, and the housing includes a release lever that engages a latch on the buffer tube adapter for locking the power source in a fixed position with respect to the buffer tube adapter. In some examples, the release lever unlocks the housing from the buffer tube adaptor for removal of the power source from the firearm. In some examples, the housing includes a socket seal providing a watertight connection between an electrode terminal and a power socket in the firearm.

In another aspect, the disclosed technology relates a power system for a firearm, the power system comprising: a buffer tube adapter having a power source compartment and configured to be connected to an unaltered buffer tube of the firearm; a power source arranged inside the power source compartment of the buffer tube adapter and configured to power electronic accessories mounted to the firearm; and a buttstock coupled to the buffer tube adapter.

In another aspect, the disclosed technology relates a method of installing a power system for a firearm, the method comprising: connecting a buffer tube adapter to a stock buffer tube of a firearm without altering the buffer tube, the buffer tube adapter having a power source compartment; connecting a buttstock to the buffer tube adapter; and inserting a power source into the power source compartment.

In some examples, the method further includes mounting one or more electronic accessories to the firearm; electrically connecting the plurality of electronic accessories to the power source; and powering the electronic accessories from the power source.

In some examples, the method further includes actuating a release lever to release the power source from the buffer tube adapter; and removing the power source from the power source compartment by sliding the power source through an opening in the buttstock.

In some examples, the method further includes inserting a second power source through the opening in the buttstock; sliding the second power source into the power source compartment; and engaging the second power source with a latch coupled to the release lever to secure the second power source in the power source compartment.

A variety of additional aspects will be set forth in the description that follows. The aspects can relate to individual features and to combination of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings.

DETAILED DESCRIPTION

Figure 1:
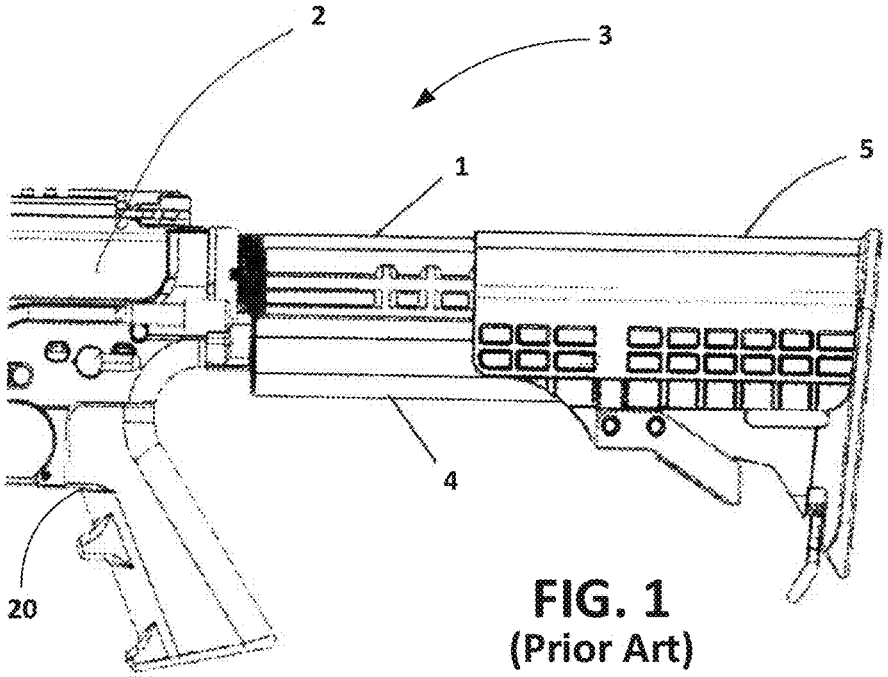
FIG. 1 (Prior Art)
FIG. 1 is a side view of a previous power system for a firearm.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Figure 2:
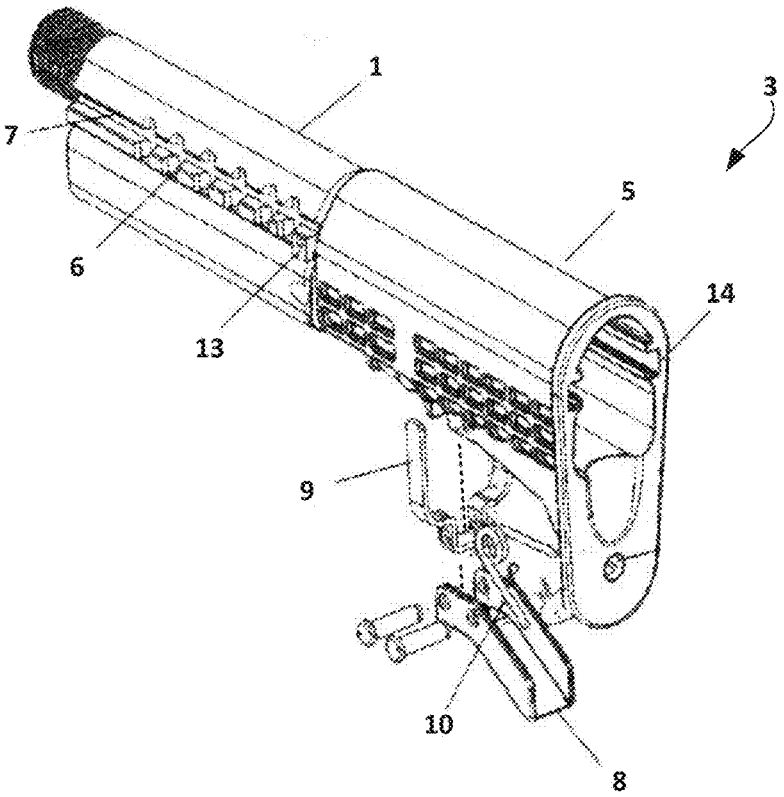
FIG. 2 (Prior Art)
FIG. 2 is an isometric view of the previous power system.

FIG. 1 is a side view of a previous power system 3 for a firearm 20. FIG. 2 is an isometric view of the previous power system 3. As shown in FIGS. 1 and 2, the previous power system 3 includes a buffer tube 1 and a battery pack 4 attached thereto. The buffer tube 1 extends from a receiver 2 of the firearm 20. The battery pack 4 is attachable to the bottom of the buffer tube 1 and is partially encapsulated by an adjustable buttstock 5.

The adjustable buttstock 5 provides a compartment underneath the buffer tube 1 which allows insertion and removal of the battery pack 4 through the rear of the firearm 20. The battery pack 4 mounts on the buffer tube 1 independent of the adjustable buttstock 5 which telescopes along the firearm 20. The adjustable buttstock 5 is collapsible and can be extended in various multiple intermediate positions providing an adjustable overall length of the firearm 20.

As shown in FIG. 2, the buffer tube 1 includes indexing notches 6 and a slide guide ramp 7 that extend along the length of the buffer tube 1 and that allow the adjustable buttstock 5 to lock onto the buffer tube 1 in multiple positions for adjusting the length of the firearm 20. A release lever 8, a latch arm 9, and a torsion spring 10 are mounted onto the adjustable buttstock 5 and held together with clevis pins 11 and retaining rings 12.

A pull of the release lever 8 disengages the latch arm 9 and slides the latch arm 9 away from an interface with an indexing notch 6 of the buffer tube 1. This allows free adjustment of the adjustable buttstock 5 guided by the slide guide slot 14 until stopped by the release stop tab 13. When the release lever 8 is released, the torsion spring 10 forces the latch arm 9 into position which automatically engages into one of the interfaces of the indexing notches 6 and locks the adjustable buttstock 5 into position.

Figure 3:
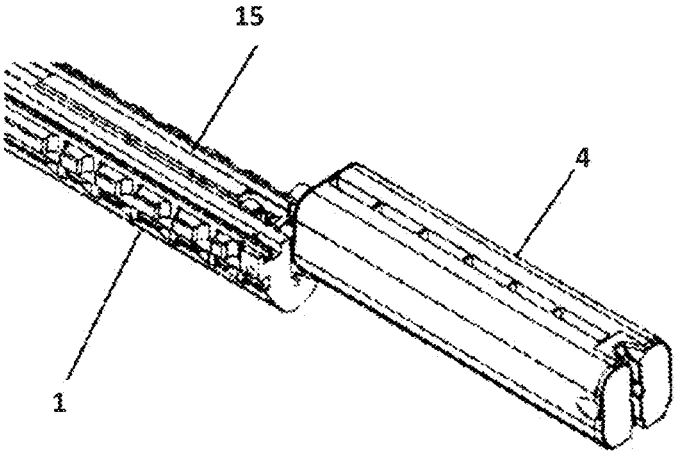
FIG. 3 (Prior Art)
FIG. 3 is a bottom isometric view of a buffer tube and a battery pack.
Figure 4:
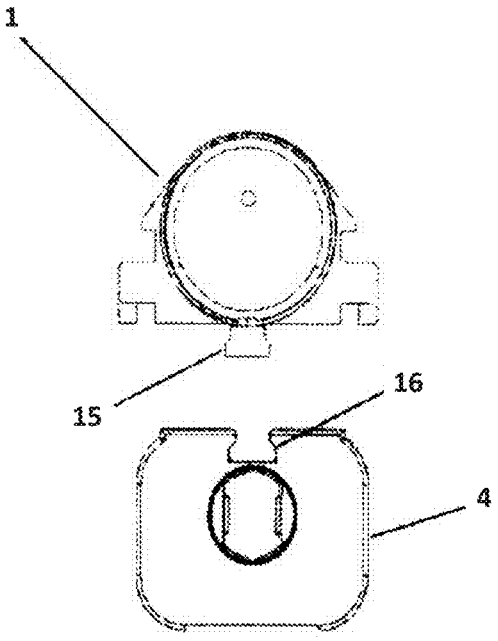
FIG. 4 (Prior Art)
FIG. 4 is an end view of the buffer tube and the battery pack.

FIG. 3 is a bottom isometric view of the buffer tube 1 and the battery pack 4. FIG. 4 is an end view of the buffer tube 1 and the battery pack 4. As shown in FIGS. 3 and 4, the buffer tube 1 includes a dovetail guide 15 that extends longitudinally, and the battery pack 4 has a mating dovetail channel 16. The mating dovetail channel 16 can be inserted into the dovetail guide 15 of the buffer tube 1 so that the battery pack 4 can be held by the buffer tube 1.

A disadvantage of the previous power system 3 of FIGS. 1-4 is that it requires replacement of a standard buffer tube of a stock firearm with the customized buffer tube 1 that includes the dovetail guide 15 for holding the battery pack 4. Replacing a standard buffer tube with the customized buffer tube 1 may require installation by a professional gunsmith.

Figure 5:
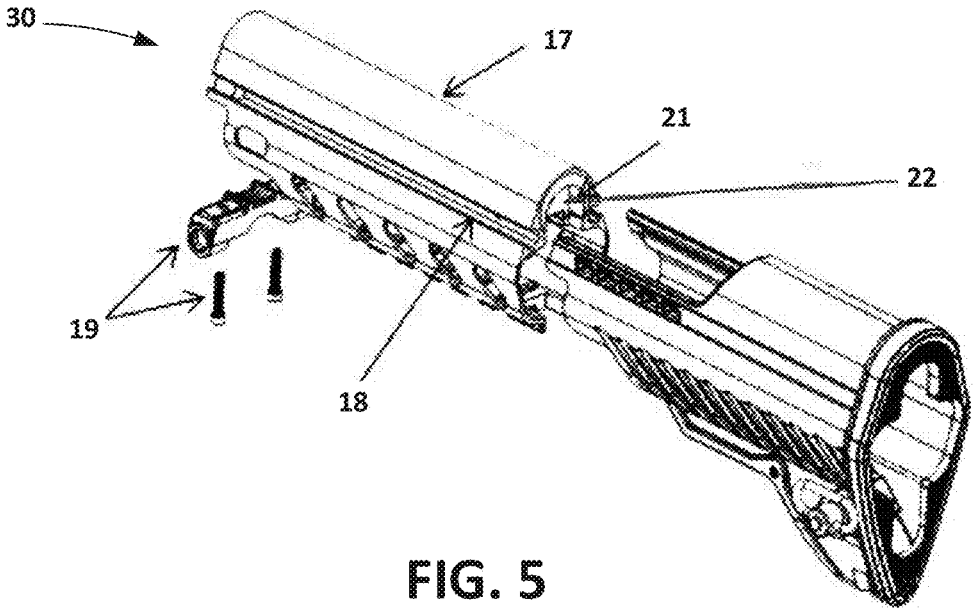
FIG. 5 is an exploded isometric view of an improved power system in accordance with the present disclosure.

FIG. 5 is an exploded isometric view of an improved power system 30. The power system 30 can be installed on a stock firearm without replacing or modifying the buffer tube. Thus, the power system 30 is a drop-in replacement that can be installed on a stock firearm at less cost and effort than the previous power system 3. The power system 30 also improves the durability of a stock firearm as the power source can be more securely attached to the stock firearm and the power system 30 maintains the stock firearm's factory setup.

As shown in FIG. 5, the power system 30 includes a buffer tube adapter 17, a slide guide channel 18, mounting bracket and screws 19, and a latch 21. The buffer tube adapter 17 can be made from a strong and light weight material, and is attachable to the rear of a stock firearm. The mounting bracket and screws 19 can be used to secure the buffer tube adapter 17 to the stock firearm. The buffer tube adapter 17 provides a compartment 22 for holding a power source. The compartment 22 is axially aligned with a channel 24 of a buttstock 25.

As shown in FIG. 5, the buffer tube adapter 17 includes the slide guide channel 18 on an exterior surface. The slide guide channel 18 is located on both sides of the buffer tube adapter 17, and extends longitudinally across the length of the buffer tube adapter 17.

Figure 6:
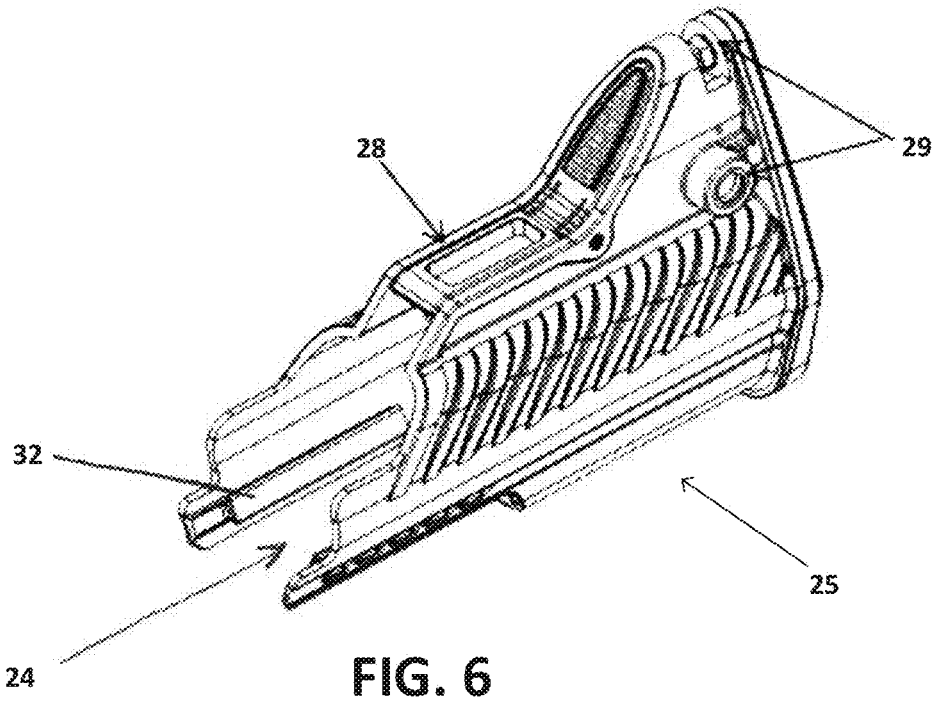
FIG. 6 is an isometric bottom view of a buttstock in the power system.

FIG. 6 is an isometric bottom view of the buttstock 25. The buttstock 25 is collapsible and can be made from a polymer material. The buttstock 25 includes a rail 32 having a dove tail groove on an interior surface of the buttstock 25. The dove tail groove of the rail 32 is slidably engageable with the slide guide channel 18 of the buffer tube adapter 17 such that the buttstock 25 can slide up and down the buffer tube adapter 17 along a longitudinal axis.

FIG. 6 shows a release latch 28 disposed on a bottom surface of the buttstock 25. The release latch 28 engages the buffer tube 1 of the firearm (as will be described in more detail). FIG. 6 further shows a sling mount 29 for attaching a sling to the buttstock 25 of the firearm.

Figure 7:
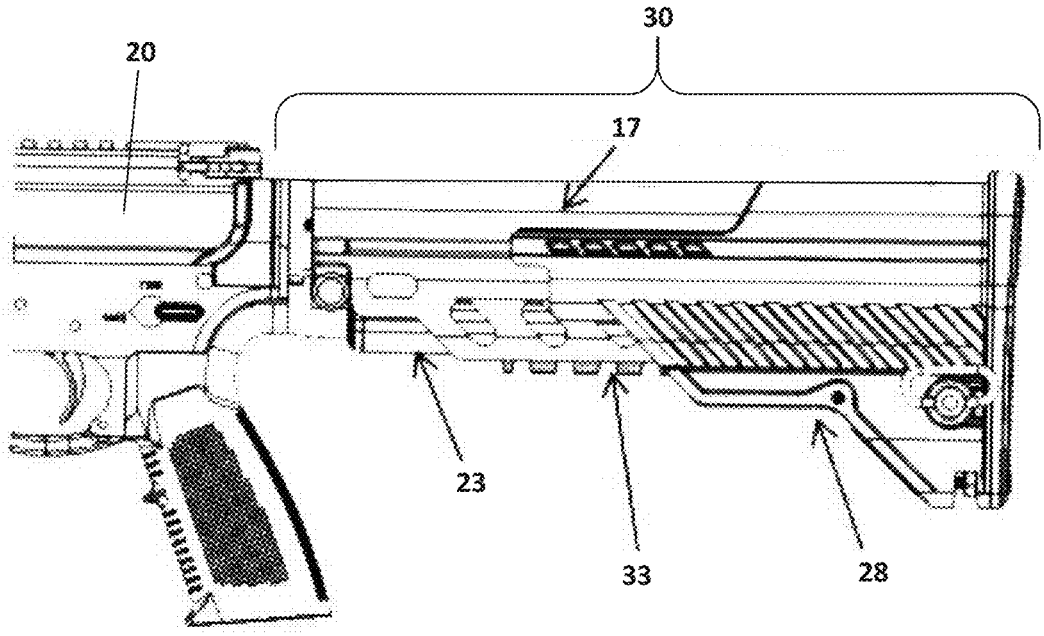
FIG. 7 is a side view of the assembled power system attached to a firearm.

FIG. 7 is a side view of the power system 30 attached to a firearm 20. Although, the power system 30 is shown and described as attached to a carbine assault rifle, the power system 30 can be attached to any type of firearm including automatic, semi-automatic, and bolt action rifles, as well as handguns and pistols. Accordingly, it is to be understood that the power system 30 can be used with a variety of firearms.

As shown in FIG. 7, the release latch 28 of the buttstock 25 is engagable with indexing notches 33 on a bottom surface of the buffer tube adapter 17. The indexing notches 33 can lock the buttstock 25 into a fixed position to adjust the length of the firearm 20. Thus, the buttstock 25 can be extended in multiple intermediate positions along the buffer tube adapter 17 for adjusting the length of the firearm 20.

Figure 8:
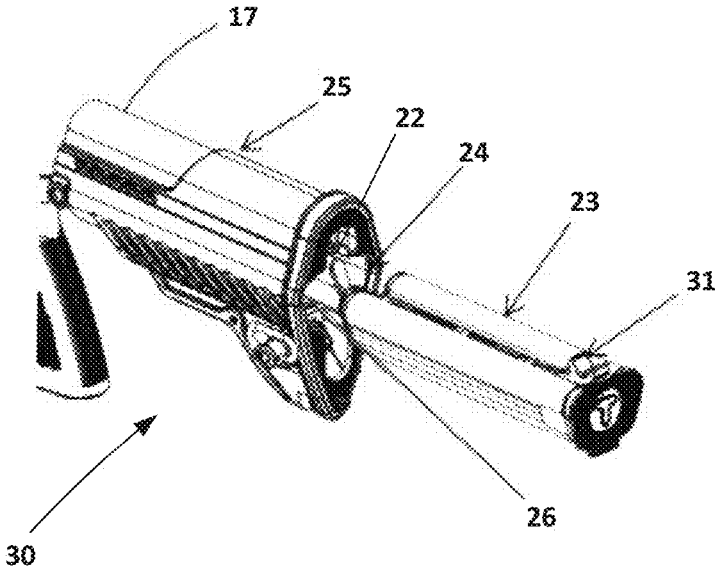
FIG. 8 is an isometric view of a power source partially inserted into the power system.

FIG. 8 is an isometric view of a power source 23 partially inserted into the power system 30. As shown in FIG. 8, the power source 23 can be installed through an opening 26 at the rear of the buttstock 25 and can be inserted into the channel 24 of the buttstock 25 so that the power source 23 is held inside the compartment 22 of the buffer tube adapter 17 and is at least partially covered by the buffer tube 25. A release lever 31 on the power source 23 is engagable with the latch 21 (shown in FIG. 2) located at the rear of the buffer tube adapter 17 for locking the power source 23 in place once completely inserted into the compartment 22.

Figure 9:
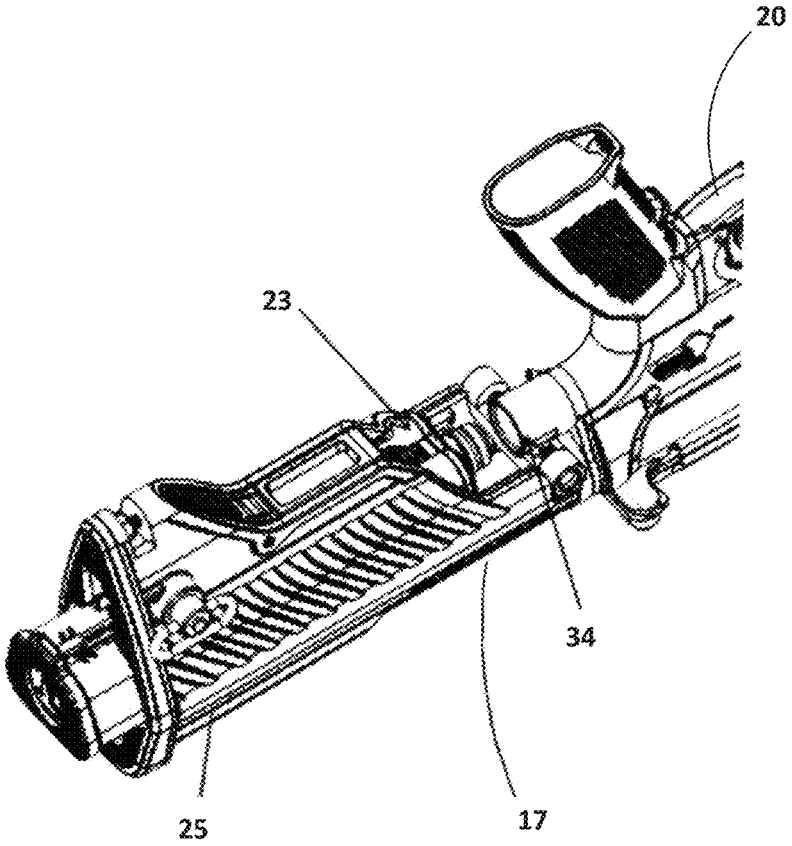
FIG. 9 is a bottom isometric view of a connection of the power source to a firearm.

FIG. 9 is a bottom isometric view of a connection of the power source 23 to the firearm 20. As shown in FIG. 9, when the power source 23 is held in the compartment 22 of the buffer tube adapter 17, the power source 23 is connected to a power socket 34 for supplying power to accessories mounted to the firearm 20. The location of the power source 23 within the firearm 20 offers functional advantages toward the overall balance, usability, and ergonomics of the firearm. Also, the location provides a convenient method of replacing and charging the power source 23.

Figure 10:
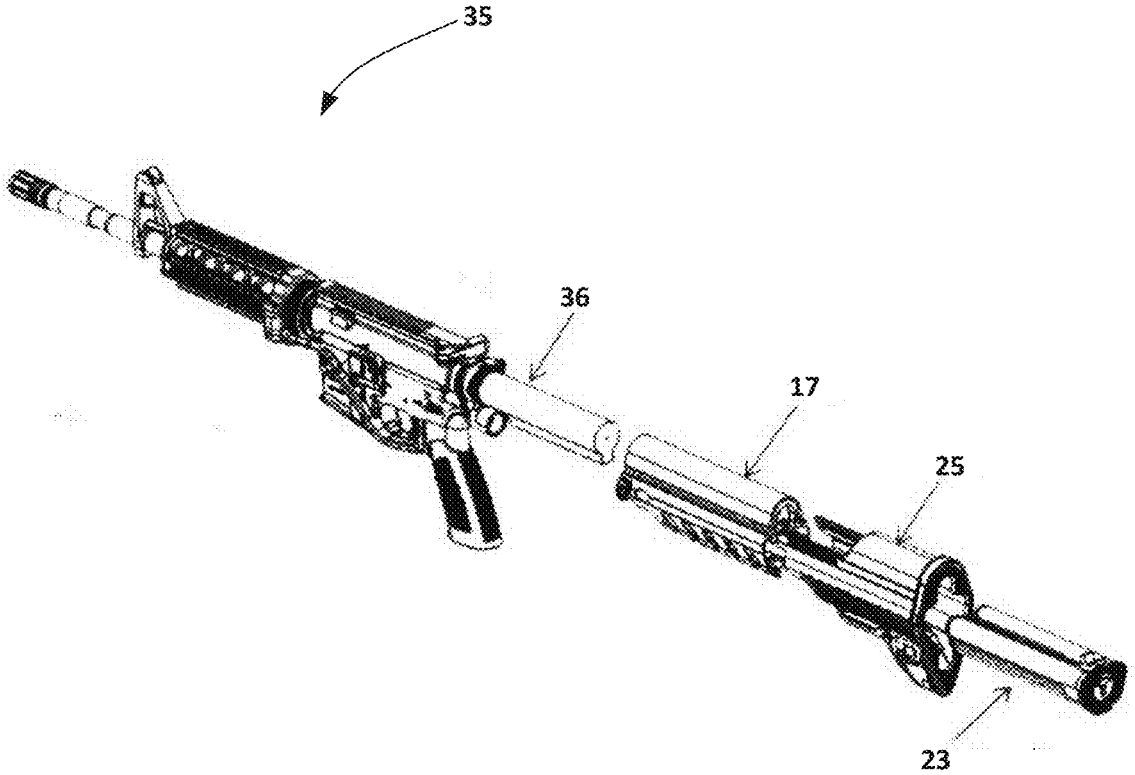
FIG. 10 is an exploded isometric view of a firearm with the power system of FIG. 5.
Figure 11:
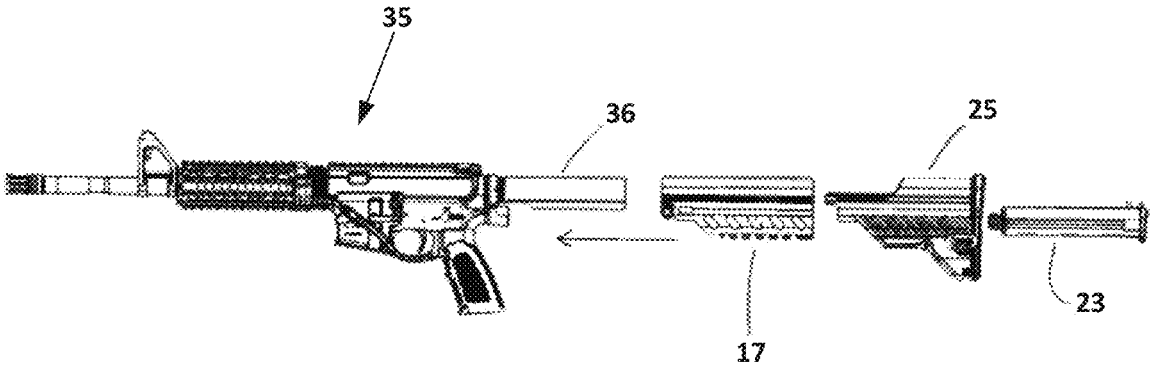
FIG. 11 is an exploded side view of the firearm of FIG. 10.

FIG. 10 is an exploded isometric view of the firearm 20, a stock buffer tube 36, the buffer tube adapter 17, the buttstock 25, and the power source 23. FIG. 11 is an exploded side view of the components shown in FIG. 10. As shown in FIGS. 10 and 11. the buffer tube adapter 17 is assembled at the rear of the firearm 20, and encapsulates the stock buffer tube 36.

The buffer tube adapter 17 holds the power source 23 when it is inserted through the buttstock 25. This allows modification of the firearm 20 to include the power system 30 without having to modify or replace the stock buffer tube 36. Instead, a firearm user can replace the stock buttstock and the stock grip of the firearm 20, with the power system 30.

Figure 12:
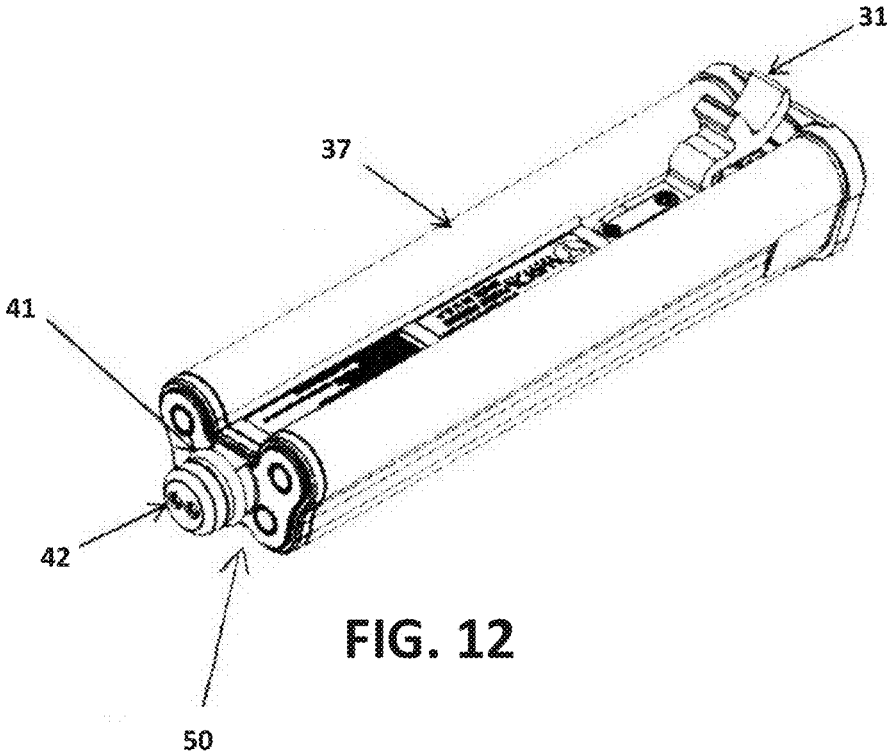
FIG. 12 is a top isometric view of a housing for a power source.

FIG. 12 is a top isometric view of a housing 37 for the power source 23. As shown in FIG. 12, the housing 37 includes a release lever 31 that can engage the latch 21 disposed at the rear end of the buffer tube adapter 17 for locking the power source 23 in place once completely inserted into the power system 30. Depressing the release lever 31 unlocks the housing 37 for removal and replacement. The housing 37 further includes a cover 50 having a socket seal 41 and an electrode terminal 42 for interfacing with the power socket 34 of the firearm. The cover 50 can be made from a polymer material such as plastic. When the power source 23 is locked into the buffer tube adapter 17, a physical connection between the electrode terminal 42 and the power socket 34 supplies energy for powering electronic accessories mounted to the firearm 20. The socket seal 41 can be made from a rubber material to provide a watertight seal between the electrode terminal 42 and the power socket 34 of the firearm 20.

Figure 13:
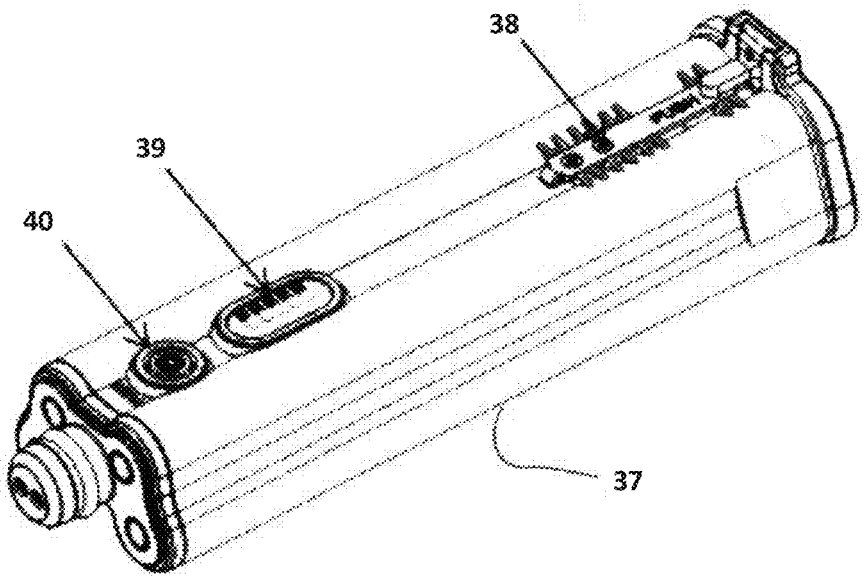
FIG. 13 is a bottom isometric view of the housing of FIG. 12.

FIG. 13 is a bottom isometric view of the housing 37. As shown in FIG. 13, the housing 37 can include a holder latch 38, an LED light state of charge indicator 39, and a pushbutton state of charge indicator 40. When a user pushes the pushbutton state of charge indicator 40, the LED light state of charge indicator 39 indicates the state of charge of the power source 23.

Figure 14:
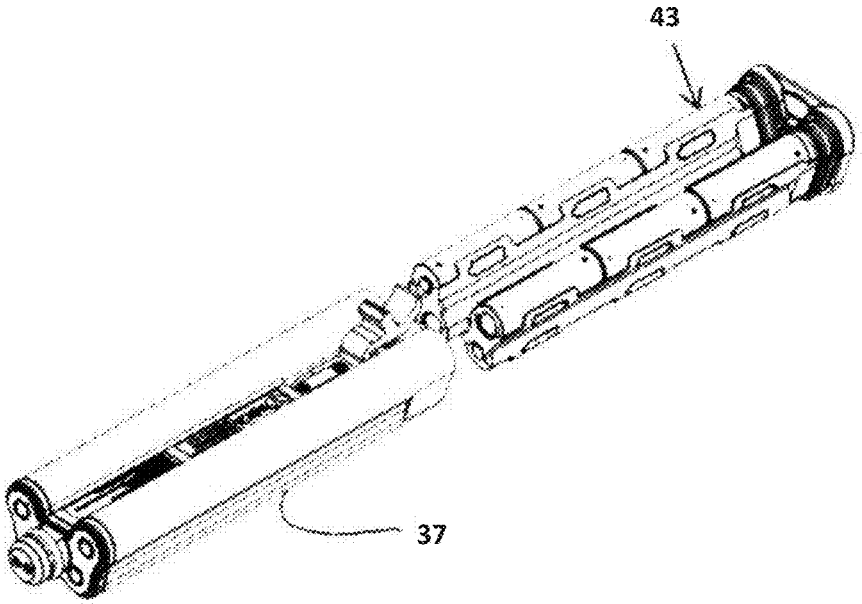
FIG. 14 is an isometric view of a holder within the housing of FIG. 12.

FIG. 14 is an isometric view of the housing 37 and a holder 43 located within the housing 37. As shown in FIG. 14, the holder 43 is received inside the housing 37 and is shaped for holding the power source 23. The holder 43 can be made from a polymer material such as plastic. In the example shown in FIG. 14, the power source 23 is depicted as having AA batteries, and accordingly, the holder 43 is shaped to hold standard AA batteries.

In some examples, the holder 43 is shaped to hold 12 AA batteries. In other examples, the holder 43 can be shaped to hold more than 12 AA batteries or fewer than 12 AA batteries. In alternative examples, the holder 43 can be configured to hold batteries that are of a different size and shape than AA batteries. Furthermore, in alternative examples, the holder 43 can be shaped to hold different types of energy sources such as, for example, rechargeable batteries, and the housing 37 could be modified to hold the rechargeable batteries.

Figure 15:
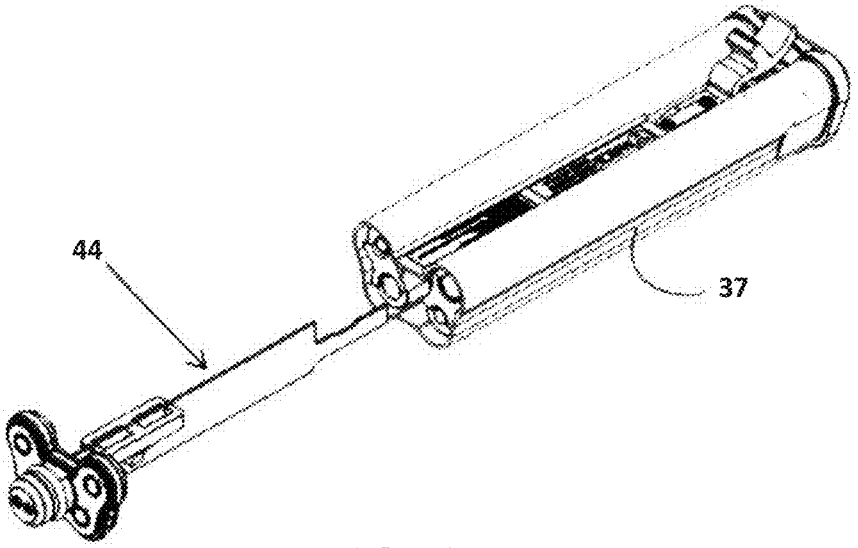
FIG. 15 is an isometric view of control electronics inside the housing of FIG. 12.

FIG. 15 is an isometric view of the housing 37 and control electronics 44 housed inside the housing 37. As shown in FIG. 15, the control electronics 44 are mounted to the front of the housing 37 so that they can be connected to the socket seal 41 and the electrode terminal 42. The control electronics 44 can be used to manage and control the power source 23.

As shown in FIGS. 12-15, the housing 37 can securely hold the power source 23 under severe environmental conditions such as during the discharge of the firearm 20. The housing 37 can also connect the power source 23 to the power socket 34 over a long period of time, and under severe conditions without causing power failure due to defective contact between the electrode terminal 42 and the power socket 34. Furthermore, the housing 37 also facilitates the replacement of the power source 23 without the need of special tools such that the firearm user can easily replace the power source 23 while in the field of operation and under duress. Also, the housing 37 can protect the power source 23 from water, dust, and other contaminants in the field.

Figure 16:
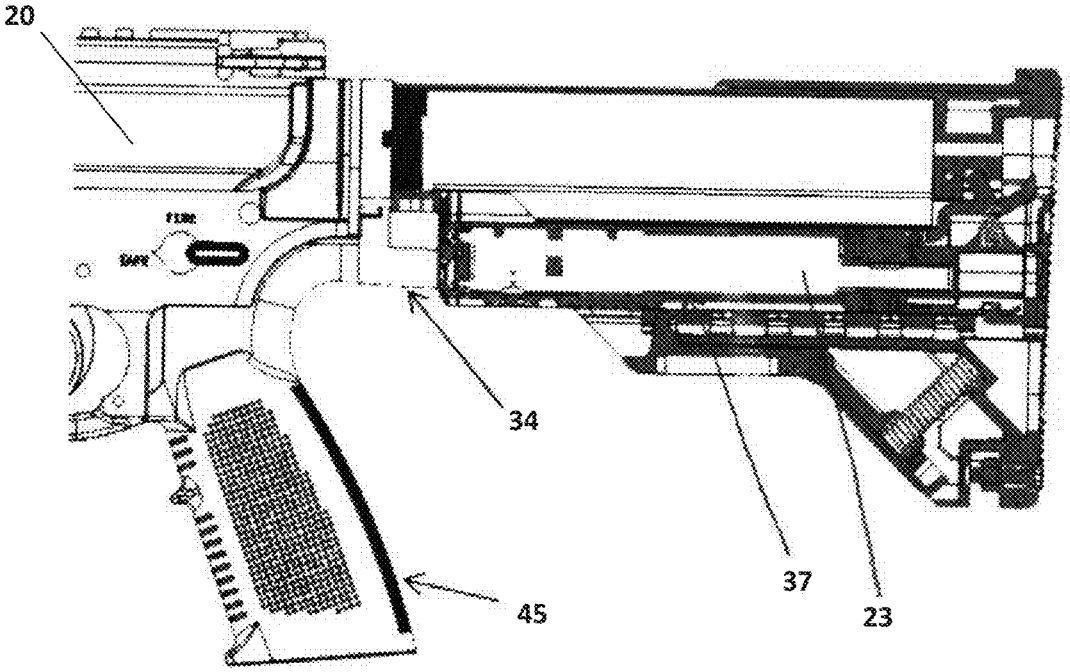
FIG. 16 is a side view of a firearm having a grip and a power socket.
Figure 17:
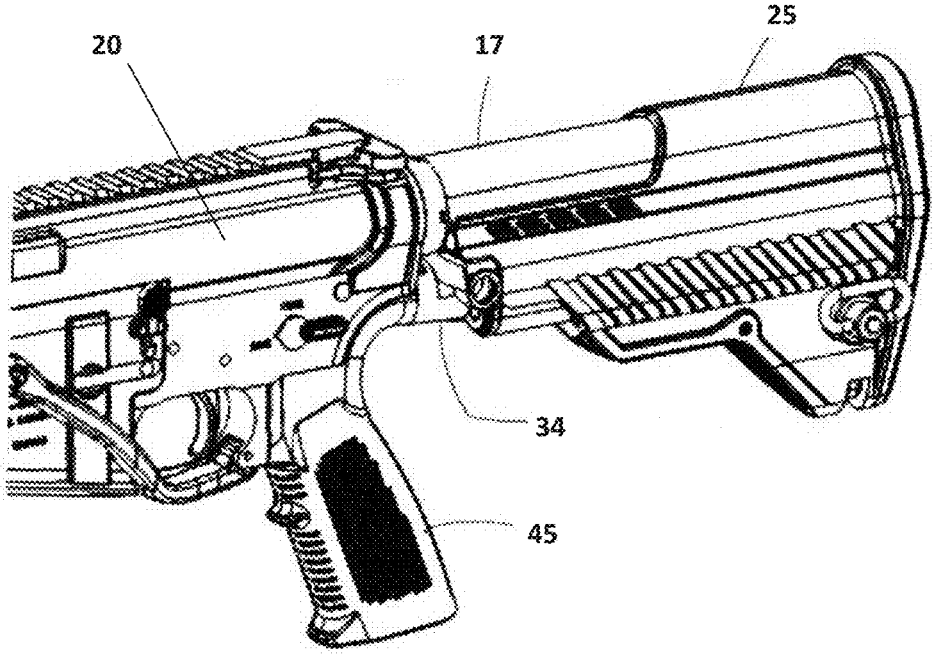
FIG. 17 is an isometric view of the firearm of FIG. 16.

FIG. 16 is a side view of the firearm 20 having a grip 45 and a power socket 34. FIG. 17 is an isometric view of the firearm 20. As shown in FIGS. 16 and 17, the grip 45 of the firearm 20 is integrated with the power socket 34. This allows for easy insertion and alignment of the housing 37 of the power source 23 into the firearm 20, and facilitates easy replacement of the power source 23 after it has been fully discharged.

Figure 18:
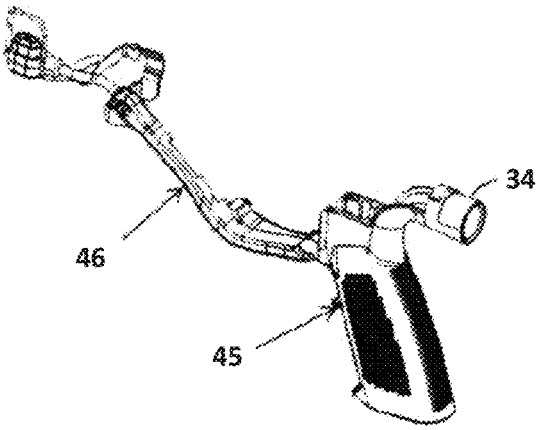
FIG. 18 is an isometric view of a power connector connected to a grip.
Figure 19:
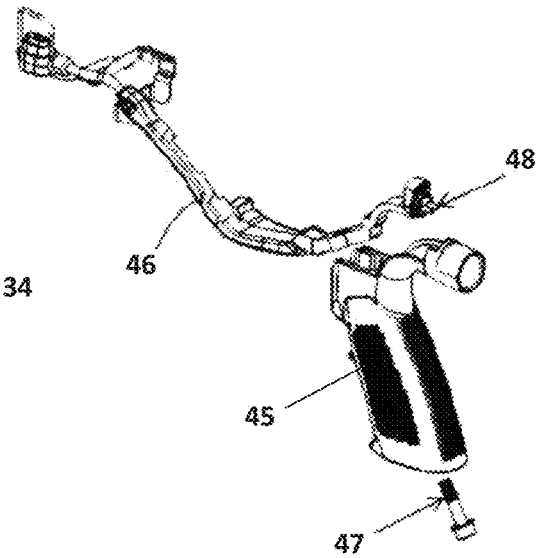
FIG. 19 is an exploded isometric view of the power connector and the grip.
Figure 20:
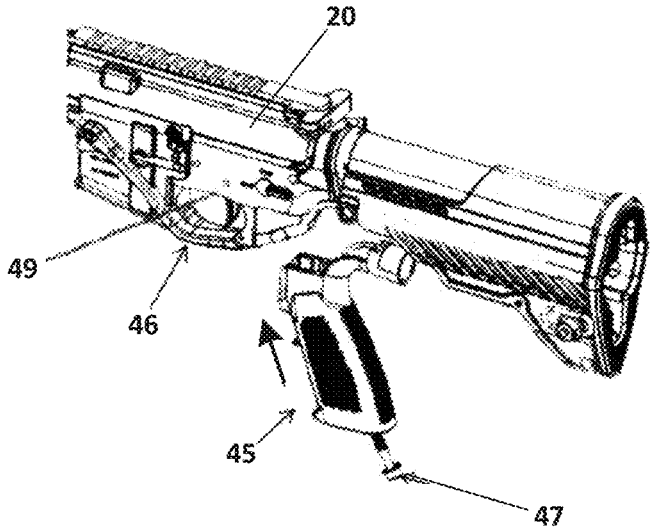
FIG. 20 is an exploded isometric view of a firearm, the power connector, and the grip.

FIG. 18 is an isometric view of a power connector 46 connected to the grip 45. FIG. 19 is an exploded isometric view of the power connector 46 and the grip 45. FIG. 20 is an exploded isometric view of the firearm 20, the power connector 46, and the grip 45. As shown in FIGS. 18-20, the power connector 46 is integrated with the grip 45. The power connector 46 transmits power from the power source 23 via the power socket 34 to the front of the firearm 20 for powering firearm mounted accessories. Power pins 48 attach the power connector 46 to the grip 45. The grip 45 can be assembled to the receiver 49 of the firearm via an assembly screw 47.

As described above, primary batteries such as AA batteries can be used as the power source 23 for powering the firearm 20 due to the reliability and maturity of primary battery technology. While primary batteries can be used as the power source 23 of the powering system, additional power sources are contemplated such as fuel cells. In some examples, fuel cells can also be used to supplement primary batteries in a hybrid system.

It is also contemplated that secondary batteries which can be recharged after use, and are hence re-usable, can be used as the power source 23. Secondary batteries such as lead-acid, silver-zinc, and metal hydride types of secondary batteries can be used as the power source 23. Also, advanced technologies including, for example, Li-ion and Li polymer chemistries, nickel metal hydride, and lithium sulfur can be used as the power source 23 for powering the firearm mounted accessories. Li-ion batteries may include several different chemistries, including LiCoO2, LiNiO2, and LiMn2O4 positive electrodes. Capacitors, including super-capacitors, ultracapacitors, or banks of capacitors could also be used.

Figure 21:
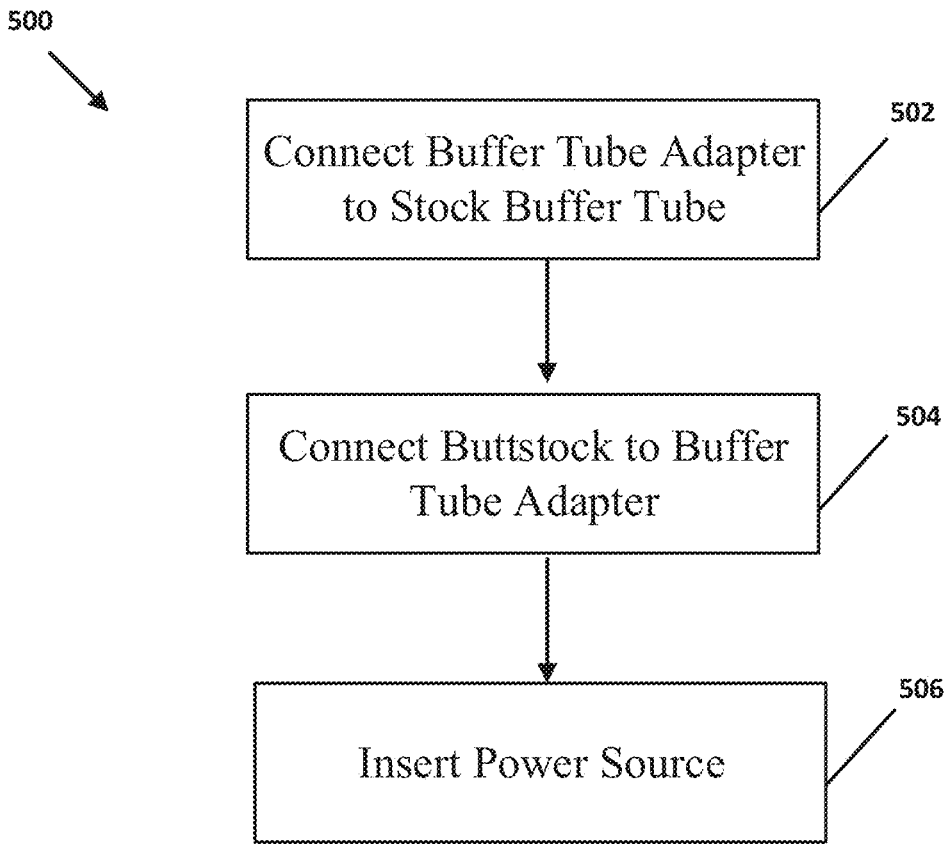
FIG. 21 illustrates a method of installing a power system onto a firearm.

FIG. 21 illustrates a method 500 of installing a power system onto a firearm. The method 500 includes a step 502 of connecting a buffer tube adapter to a stock buffer tube of a firearm without altering the stock buffer tube. Next, the method 500 includes a step 504 of connecting a buttstock to the buffer tube adapter. Thereafter, the method 500 includes a step 506 of inserting a power source into a power source compartment of the buffer tube adapter.

In some examples, the method 500 may include additional steps of mounting one or more electronic accessories to the firearm, electrically connecting the electronic accessories to the power source, and powering the electronic accessories from the power source.

In some examples, the method 500 may include additional steps of actuating a release lever to release the power source from the buffer tube adapter, and removing the power source from the power source compartment by sliding the power source through an opening in the buttstock. In some examples, the method 500 may include further steps of inserting a second power source through the opening in the buttstock, sliding the second power source into the power source compartment, and engaging the second power source with a latch coupled to the release lever to secure the second power source in the power source compartment.

The various embodiments described above are provided by way of illustration only and should not be construed to limit the claims attached hereto. Those skilled in the art will readily recognize various modifications and changes that may be made without following the example embodiments and application illustrated and described herein, and without departing from the true spirit and scope of the following claims.

What is claimed is:

1. A power system for a firearm, the power system comprising:

a buffer tube adapter configured to attach to and surround a buffer tube of the firearm without replacing or modifying the buffer tube, the buffer tube adapter includes a mounting bracket that secures the buffer tube adapter to the buffer tube of the firearm, the buffer tube adapter further includes a slide guide channel;

a buttstock that includes a rail that slidably engages with the slide guide channel of the buffer tube adapter along an axis, the buttstock configured to adjust a length of the firearm; and a power source held by the buffer tube adapter and separable from the buffer tube adapter while the buffer tube adapter remains attached to the buffer tube, the power source at least partially covered by the buttstock, the power source configured to power electronic accessories mounted to the firearm.

2. The power system of claim 1, wherein the power system is mountable to the firearm without altering the buffer tube of the firearm.

3. The power system of claim 1, wherein the power source is held inside a compartment of the buffer tube adapter, and the compartment is axially aligned with a channel in the buttstock.

4. The power system of claim 1, wherein the buffer tube adapter includes indexing notches that lock the buttstock in multiple intermediate positions along the axis.

5. The power system of claim 1, wherein the power source is configured to connect to a power socket mounted to a grip of the firearm.

6. The power system of claim 1, wherein the power source comprises AA batteries.

7. The power system of claim 1, wherein the power source comprises rechargeable batteries.

8. The power system of claim 1, wherein the power source comprises a fuel cell.

9. The power system of claim 1, wherein the power source is housed inside a housing, and the housing includes a release lever that engages a latch on the buffer tube adapter for locking the power source in a fixed position with respect to the buffer tube adapter.

10. The power system of claim 9, wherein the release lever unlocks the housing from the buffer tube adaptor for removal of the power source from the firearm.

11. The power system of claim 9, wherein the housing includes a socket seal providing a watertight connection between an electrode terminal and a power socket in the firearm.

12. A firearm comprising the power system of claim 1.

13. A power system for a firearm, the power system comprising:

a buffer tube adapter having a power source compartment and configured to be connected to and surround an unaltered buffer tube of the firearm without replacing the unaltered buffer tube, the buffer tube adapter includes a mounting bracket that secures the buffer tube adapter to the buffer tube of the firearm;

a power source arranged inside the power source compartment of the buffer tube adapter and configured to power electronic accessories mounted to the firearm, the power source being separable from the power source compartment of the buffer tube adapter while the buffer tube adapter remains connected to the buffer tube; and a buttstock coupled to the buffer tube adapter.

14. A method of installing a power system for a firearm, the method comprising:

connecting a buffer tube adapter to a stock buffer tube of a firearm without altering or replacing the buffer tube by using a mounting bracket to secure the buffer tube adapter to the buffer tube of the firearm, the buffer tube adapter having a power source compartment;

connecting a buttstock to the buffer tube adapter; and inserting a power source into the power source compartment.

15. The method of claim 14, further comprising:

mounting one or more electronic accessories to the firearm;

electrically connecting the plurality of electronic accessories to the power source; and powering the electronic accessories from the power source.

16. The method of claim 14, further comprising:

actuating a release lever to release the power source from the buffer tube adapter; and removing the power source from the power source compartment by sliding the power source through an opening in the buttstock.

17. The method of claim 14, further comprising:

inserting a second power source through the opening in the buttstock;

sliding the second power source into the power source compartment; and engaging the second power source with a latch coupled to the release lever to secure the second power source in the power source compartment.

* * * * *